US006032553A

United States Patent [19]

Brucart Puig et al.

[11] Patent Number: 6,032,553

[45] Date of Patent: Mar. 7, 2000

[54] CORKSREW

[76] Inventors: Ramón Brucart Puig; Marta Bonich Linares, both of Gustavo Becquer, 105, 08206, Sabadell (Barcelona), Spain

[21] Appl. No.: 09/066,681

[22] Filed: Apr. 28, 1998

[30] Foreign Application Priority Data

Apr. 28, 1997 [ES] Spain ..... 9701138

[51] Int. Cl.[7] ..... B67B 7/44

[52] U.S. Cl. ..... 81/3.09; 81/3.37; 81/3.47; 81/3.56; 7/155; 7/156

[58] Field of Search ..... 81/3.47, 3.09, 81/3.35, 3.36, 3.37, 3.29, 3.55, 3.56, 3.57, 3.48; 7/151, 155, 156

[56] References Cited

U.S. PATENT DOCUMENTS 455,826 7/1891 Davis ..... 30/1.5
786,492 4/1905 Garimaldi ..... 81/3.09
1,058,049 4/1913 Greenhut ..... 81/3.36
1,109,073 9/1914 Labreche ..... 7/155 X
4,996,895 3/1991 Brucart Puig ..... 81/3.09

*Primary Examiner*—D. S. Meislin
*Attorney, Agent, or Firm*—Pillsbury Madison & Sutro LLP

[57] ABSTRACT

A manually operated corkscrew is disclosed with a substantially U-shaped body having first and second ends. A rack with teeth is moveable within the body. The rack has first and second ends and is biased to move toward the second end of the body. Two symmetrical wings are provided on the second end of the rack with an extension spike mounted therebetween. A handle, pivotally attached at a pivot to the body adjacent to the first end of the body also has an axis joint disposed adjacent to the pivot. A ratchet claw, with a claw end, is pivotally disposed on the axis joint and biased so that the claw end engages the teeth on the rack. The handle acts as a first-class lever when activated about the pivot to gradually push the rack toward the first end of the body through progressive engagement between the ratchet claw and the teeth on the rack.

7 Claims, 3 Drawing Sheets

CORKSREW

FIELD OF THE INVENTION

The present invention consists of a manually operated, multi-purpose corkscrew, designed especially and specifically for the main use of extracting cork stoppers from bottles, and to carry out various complementary operations, always within the same line of action, that is, opening bottles.

BACKGROUND OF THE INVENTION

In hotel or restaurant work, staff, especially waiters and other employees who directly serve customers, must be equipped with tools and utensils that occupy as little space as possible and which, in turn, have features to carry out different operations, all of which are related to each other in their basic aspect; utensils which, in addition, ensure that their main function can be carried out simply and with a minimum of necessary effort.

SUMMARY OF THE INVENTION

The corkscrew of the present invention is characterized in that it is designed to be able to carry out its main function adequately and correctly, that is, extracting cork stoppers, without causing any damage to the mouth of the bottle or breaking the stopper itself, and facilitating the operation so that it may be carried out with a minimum of effort.

This stopper extraction operation is facilitated by the special arrangement of the two main parts that make up the corkscrew: one of these, concerned with the action, consists of a first-class lever; the other, concerned with extraction, consists of a fluted body (or U-shaped) upon which the lever is jointed at its point of support, and inside which a fluted, running rack moves which has, in turn, a joint for the helicoidal extraction spike that is also tensed by a leaf spring and is designed to function directly as a corkscrew.

The corkscrew is likewise characterized in that the said fluted, movable rack, which is toothed, has the ability to retract automatically when the retaining ratchet claw is acted upon manually, by means of the action of a cylindrical expansion spring situated in the channel of the rack itself, thus allowing the rapid and immediate return to its original position and also allowing the helicoidal spike to fold back to its original closed position.

The complementary operations that may be carried out are, specifically, the necessary tearing of the sealing cap that generally covers the upper part of the mouth to make the upper side of the stopper accessible, and also the opening of bottles closed with stoppers of the known "crown" type (i.e. battlecap), an operation that is greatly facilitated given the elongated and ample shape of the claw-shaped projection, exclusively intended for this function, which allows both edges of the "crown" type stopper to be acted upon by an outward or an inward lever action.

Thus the corkscrew that is the object of the present invention has, as an essentially original feature, the peculiarity that the stopper extraction spike, shaped like a ringlet corkscrew, is fixed and conveniently jointed to a rack-type guide that slides inside the basic body of the utensil's handle in such a way that when the extraction spike is introduced into the stopper and the lower end of the basic body rests upon the edge of the bottle's mouth, the extractive action is performed with great ease and effectiveness, simply by operating the handle so that the ratchet claw makes the rack move upwards together with the extraction spike, so that the stopper is extracted from the mouth. It also ensures that the stopper will not break when extracted, which is an obvious advantage in properly serving the contents of the bottle.

The corkscrew that is the object of the present invention is also characterized in that the rack's movement inside the fluted basic body of the utensil's handle is carried out, as indicated hereinbefore, by manual action upon the said handle with a downward movement, so that the ratchet claw acts upon the teeth of the rack moving the latter from its initial place, the utensil's folded or closed position, to a maximum lengthwise extraction, held in place by the action of the ratchet claw itself. When one wishes to re-fold the rack partially or completely, it is necessary only to raise the ratchet claw, thereby releasing the rack which retracts by the action of a cylindrical expansion spring also situated in the fluted interior of the basic body mentioned hereinbefore.

The ratchet claw is fixed, tilting upon its supporting axis, upon the handle, at the very end that projects slightly underneath the axis that articulates the handle itself with its basic body.

Having thus described the corkscrew unit, it only remains to indicate that at the rear end of the basic body there is a limiting step for support against the edge of the bottle's mouth, which allows the lever action of the corkscrew to be performed, while at the front end of the movable rack the auxiliary blade is situated for tearing the sealing cap of the said mouth.

Finally, at the outer end of the handle there is a claw-shaped projection to allow stoppers of the known "crown" type to be opened.

Given the characteristic slightly concave shape of the handle, the unit is gathered towards the inside of it when the extraction spike is folded, overcoming the action of the spring that maintains it at a right angle in relation to the rack, remaining situated along the latter; and when the rack has retracted, having been released from the ratchet claw, by the action of the spring, towards its initial position, it is concealed completely inside the fluted basic body, also fluted, of the said handle.

In order to describe the parts that make up the multi-purpose corkscrew that is the object of the present utility model, sheets of drawings are attached which, by way of a non-restrictive example, show a practical embodiment of a corkscrew equipped with the essential characteristics mentioned.

Figure 1:
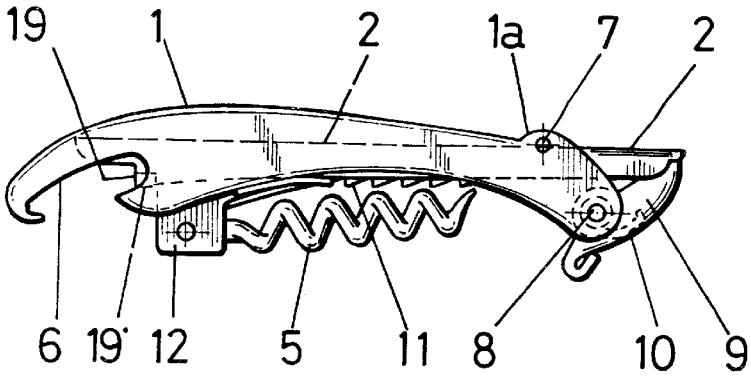
FIG. 1 is a view of the completely closed corkscrew, in the appropriate position for use, in this position, as a "crown" cap opener.

DETAILED DESCRIPTION OF THE PERFECTED EMBODIMENTS.

The multi-purpose corkscrew for bottles that is the object of the present application is made up of the following parts: the handle, of a markedly concave shape (1), the fluted basic body (2), the movable rack (3), together with its cylindrical spring (4), and the helicoidal extraction spike (5).

In accordance with the drawings, the handle (1) may be observed to be completely fluted, open underneath and fitted at the end with a projection in the form of a claw (6) for opening "crown" type stoppers; this projection is sufficiently long to enable it to act equally upon opposing flanges of the said stoppers.

At the other end of the handle there is an area that opens into two parallel wings **(1*a*), in which the axis joint (7) of the fluted basic body (2) is situated, and next to the furthest edge, the axis joint (8) of the ratchet claw (9); the function of this claw is to cause the rack (3) to move by acting upon the teeth (11), and at the same time to keep it in the desired position, preventing it from retracting due to the action of the cylindrical expansion spring (4). Under the ratchet claw (9) the spiral spring (10) is situated, which maintains it in its position of engagement with the teeth (11) of the said movable rack (3)**.

In the fluted interior of the basic body (2) the said movable rack (3) is situated, fitted with a cylindrical expansion spring (4), the basic component for causing the automatic retraction of the said rack (3) to its original position, completely concealed inside the basic body (2).

As indicated, the rack is situated in the fluted interior of the basic body (2), fitted with the expansion spring (4), which tends to return it to its initial position, which spring is fastened to a flange **(2*a*)**.

Figure 2:
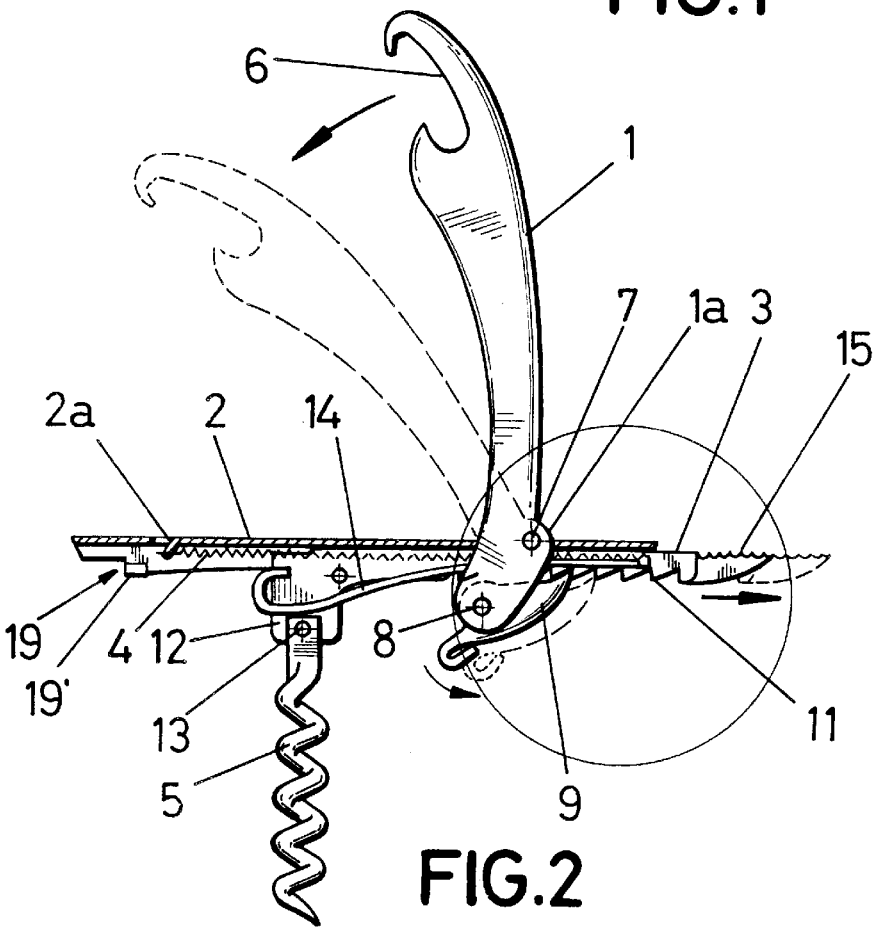
FIG. 2 is a view in longitudinal section of the open corkscrew, with the handle raised, the spike unfolded at a right angle and the rack moved slightly outward; the action of the handle and the movement of the rack pushed by the ratchet claw are drawn in sketched lines.
Figure 3:
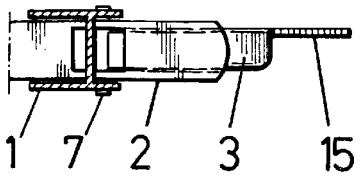
FIG. 3 is a plan view of a detail, in accordance with FIG. 2, of the end of the movable rack.
Figure 4:
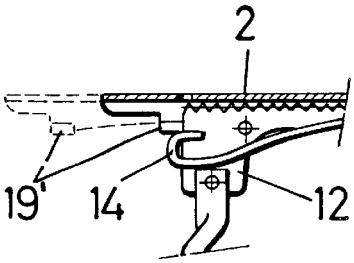
FIG. 4 is a detailed view of the rear part of the fluted basic body, showing the working flange of the extraction spike's spring.
Figure 6:
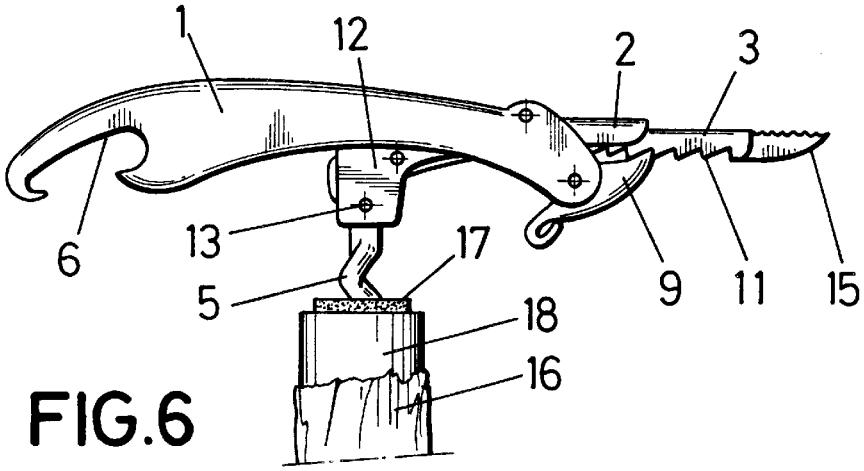
FIG. 6 shows the corkscrew with the extraction spike already screwed into a stopper preliminary to the extraction operation.

The said rack terminates at its rear part in two parallel and symmetrical wings (12) upon which the axis joint (13) of the extraction spike (5) is supported which, moving from its position of rest next to the rack itself (3) to the right angular position illustrated in FIGS. 2 and 6, is kept in this position by the action against its base of the leaf spring (14) situated in the interior, also fluted, of the rack (3). At its other end, the front end, the rack terminates in the serrated side blade (15) used for cutting or tearing the sealing cap (16) that covers the stopper (17) and the mouth of the bottle (18).

Figure 7:
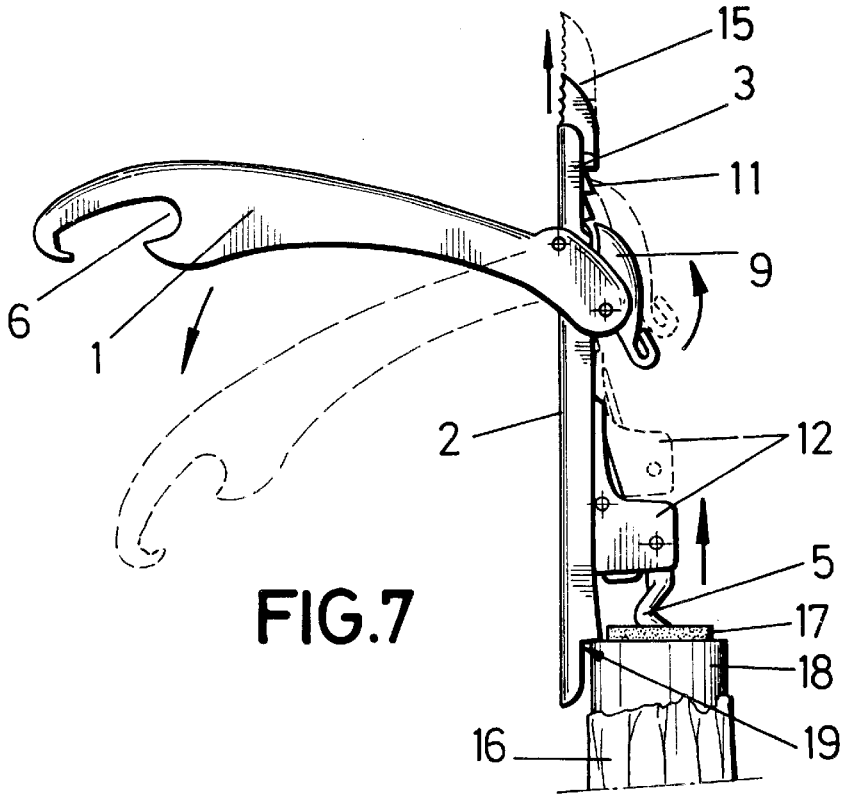
FIG. 7 is a view of the utensil in a position in which the basic body is resting its rear end upon the flange of the bottle's mouth; the action of the handle and the rack's outward movement, pushed by the ratchet claw, are shown in sketched lines.
Figure 8:
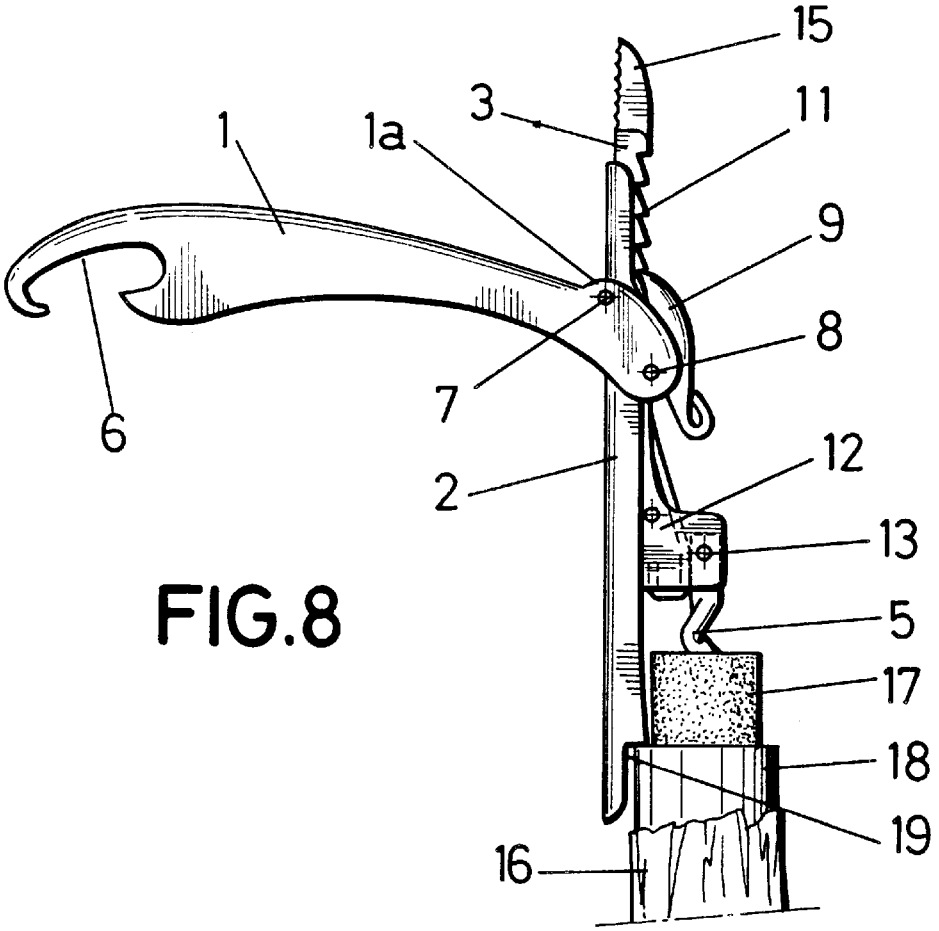
FIG. 8 is a complementary drawing equivalent to the foregoing, in which the outward movement of the rack may be observed, and also the consequent movement of the spike together with the stopper; and Finally.
Figure 9:
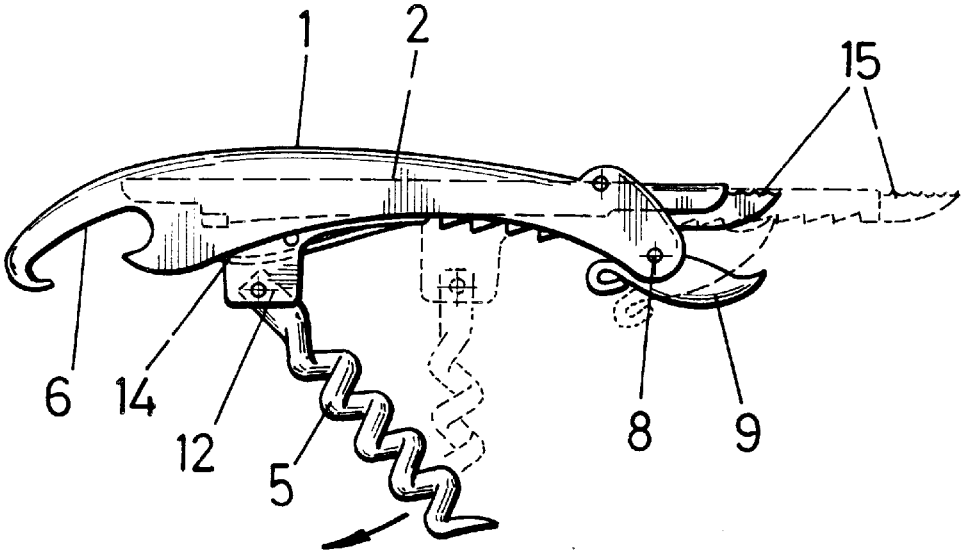
FIG. 9 is a view of the corkscrew itself, showing in sketched lines a more advanced position of the rack and the spike, as well as the retaining action of the ratchet claw.

At its rear end, the basic body (2) has a graduated projection (19) used for resting the utensil upon the edge of the bottle's (18) mouth, as may be observed in FIGS. 7 and 8, when proceeding to extract the stopper (17).

In its inner part, this graduated projection (19) widens into two side flanges (19') folded inward. These flanges work against the spring (14) of the spike (5) when the rack (3) is in its initial, retracted position. In this way, the positional stability of the spike (5) is fully ensured when it is introduced into the stopper (17), owing to the increased pressure exerted by the spring (14) upon the base of the spike (5).

To summarize everything described hereinbefore, the three functions that may be carried out with the multi-purpose corkscrew are indicated below in a summarized form:

The unit described, may be folded towards the inside of the handle (1) for easy and comfortable handling when not in use. However, it is suitable, in the position illustrated in FIG. 1, for opening stoppers of the so-called "crown" type, especially by virtue of the two ways of opening them.

Figure 5:
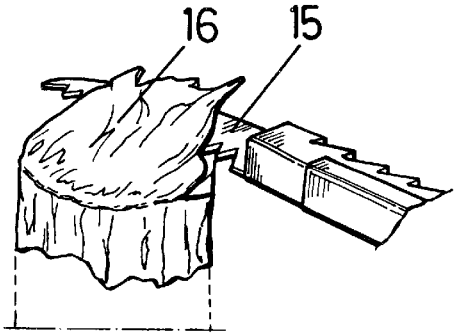
FIG. 5 is a detail of the blade at the end of the rack, tearing the upper part of a sealing cap on a bottle of wine.

By partly extracting the rack (3) forwards, as shown in FIG. 5, the sealing cap (16) may be torn, leaving the stopper (17) uncovered in the mouth of the bottle (18).

And finally, regarding the stopper (17) extraction function, once the extraction spike (5) has been suitably introduced into the longitudinal axis of the said stopper (17), the basic body (2) of the utensil is supported by a graduated projection (19) upon the mouth (18) of the bottle, at which point, as illustrated in FIGS. 7 and 8, a downward movement of the handle is caused manually which, by a first-class lever action, causes, in turn, the upward movement of the ratchet claw (9). This claw, engaging with one of the teeth (11) of the rack (3), causes the said rack to move outward together with the extraction spike (5), jointly with the wings (12), also pulling the stopper (17) with it.

In this simple way, and without effort on the part of the user, extraction of the said stopper is carried out. The position of each of the parts that participate in this operation, specifically the basic body (2), the rack (3) and the spike (5), all in the same vertical line, ensures the comfortable extraction of the stopper (17) without damaging or breaking either the stopper or the mouth of the bottle (18).

When the user has finished this operation, or at any time they wish, by raising the ratchet claw (9) by simple manual pressure the tooth (11) is released, upon which the rack (3) returns to its original position, concealed inside the fluted basic body (2), owing to the spring's (4) action; the end blade (15) is also thus concealed, preventing any danger of a cut.

All variations in shapes, dimensions and materials used in the practical embodiment of the different components of the utensil described, will not in any way alter the essential nature of the same, which is summarized in the following claims.

We claim:

1. A manually operated corkscrew, comprising:

a substantially U-shaped body having first and second ends;

a rack having teeth, being moveable within the body, having first and second ends, and being biased to move toward the second end of the body;

two symmetrical wings attached to the second end of the rack;

an extension spike pivotally mounted between the two summetrical wings on the rack;

a handle pivotally attached to the body at a pivot adjacent to the first end of the body, the handle having an axis joint disposed adjacent to the pivot;

a ratchet claw, with a claw end, pivotally disposed on the axis joint and biased so that the claw end engages the teeth on the rack;

wherein the handle acts as a first-class lever when actuated about the pivot to gradually push the rack toward the first end of the body through progressive engagement between the ratchet claw and the teeth on the rack.

2. The manually operated corkscrew of claim 1, further comprising:

a serrated blade attached to the first end of the rack.

3. The manually operated corkscrew of claim 1, wherein the handle, at its end disposed away from the pivot and axis joint, defines a double are curve that permits releasable engagement with a bottle cap to remove the bottle cap from a bottle's mouth.

4. The manually operated corkscrew of claim 1, further comprising:

a leaf spring attached to the rack and disposed between the symmetrical wings adjacent the pivotal attachment of the extension spike to bias the extension spike to a folded condition when the rack has been retracted toward the second end of the body.

5. The manually operated corkscrew of claim 1, further comprising:

a cylindrical spring attached between the rack and a point near the second end of the body to bias the rack to move toward the second end of the body.

6. The manually operated corkscrew of claim 1, further comprising:

a projection attached near the second end of the body for engagement with a bottle's mouth to facilitate extraction of a stopper from the mouth.

7. The manually operated corkscrew of claim 4, further comprising:

two side flanges, folded inwardly on the body, that apply pressure to the leaf spring so that the leaf spring will stabilize the extension spike when unfolded.

* * * * *